US011046488B2

(12) United States Patent
Versluijs et al.

(10) Patent No.: US 11,046,488 B2
(45) Date of Patent: Jun. 29, 2021

(54) CONTAINER WITH MULTI DEPRESSIBLE CAP PRESS TOP

(71) Applicant: TEAMPLAST B.V., ZH Heteren (NL)

(72) Inventors: Richard Patrick Versluijs, GE Delfgauw (NL); Gerard van Amerongen, HR Bennekom (NL)

( * ) Notice: Subject to any disclaimer, the term of this patent is extended or adjusted under 35 U.S.C. 154(b) by 391 days.

(21) Appl. No.: 15/781,184

(22) PCT Filed: Dec. 31, 2015

(86) PCT No.: PCT/EP2015/081471
§ 371 (c)(1),
(2) Date: Jun. 4, 2018

(87) PCT Pub. No.: WO2017/114583
PCT Pub. Date: Jul. 6, 2017

(65) Prior Publication Data
US 2020/0262625 A1 Aug. 20, 2020

(51) Int. Cl.
*B65D 51/28* (2006.01)

(52) U.S. Cl.
CPC ..... *B65D 51/2835* (2013.01); *B65D 51/285* (2013.01)

(58) Field of Classification Search
CPC ..... B65D 51/2835; B65D 51/285
USPC ..... 206/222
See application file for complete search history.

(56) References Cited

U.S. PATENT DOCUMENTS 4,770,305 A * 9/1988 Su ..... B65D 51/224 215/250
5,255,812 A * 10/1993 Hsu ..... A47J 36/28 220/277
7,175,049 B2 * 2/2007 Kastenschmidt .... B65D 51/226 206/219
8,746,476 B1 * 6/2014 Clause ..... B65D 47/36 215/277
2004/0026422 A1 * 2/2004 Westphal ..... B65D 51/224 220/277
2006/0151421 A1 * 7/2006 Rho ..... B65D 51/224 215/297
2007/0181522 A1 * 8/2007 Davidson ..... B65D 47/0814 215/228
2010/0200437 A1 * 8/2010 Coon ..... B65D 25/085 206/222
2011/0174642 A1 * 7/2011 Coon ..... B65D 51/2835 206/222
2011/0284402 A1 * 11/2011 Sharp ..... B65D 51/2835 206/222
2012/0193249 A1 * 8/2012 Lizerbram ..... B65D 47/243 206/222

(Continued)

*Primary Examiner* — Jacob K Ackun
(74) *Attorney, Agent, or Firm* — John F. Vodopia

(57) ABSTRACT

A substance container has a cap that defines a cap space for an additive. The cap has a cap space opening closed by a seal which may or may not be pre-weakened, and a flexible press top having a pushing mechanism that reaches through the cap space attached on one end to the flexible top, while another end of the pushing mechanism is directed to the opening. The flexible press top has an upper side and an opposite lower side arranged such that upon depression the pushing mechanisms hold fixed radial positions during translation to the opening, contact with the seal and push through the seal.

7 Claims, 7 Drawing Sheets

(56) References Cited

U.S. PATENT DOCUMENTS

Figure 1:
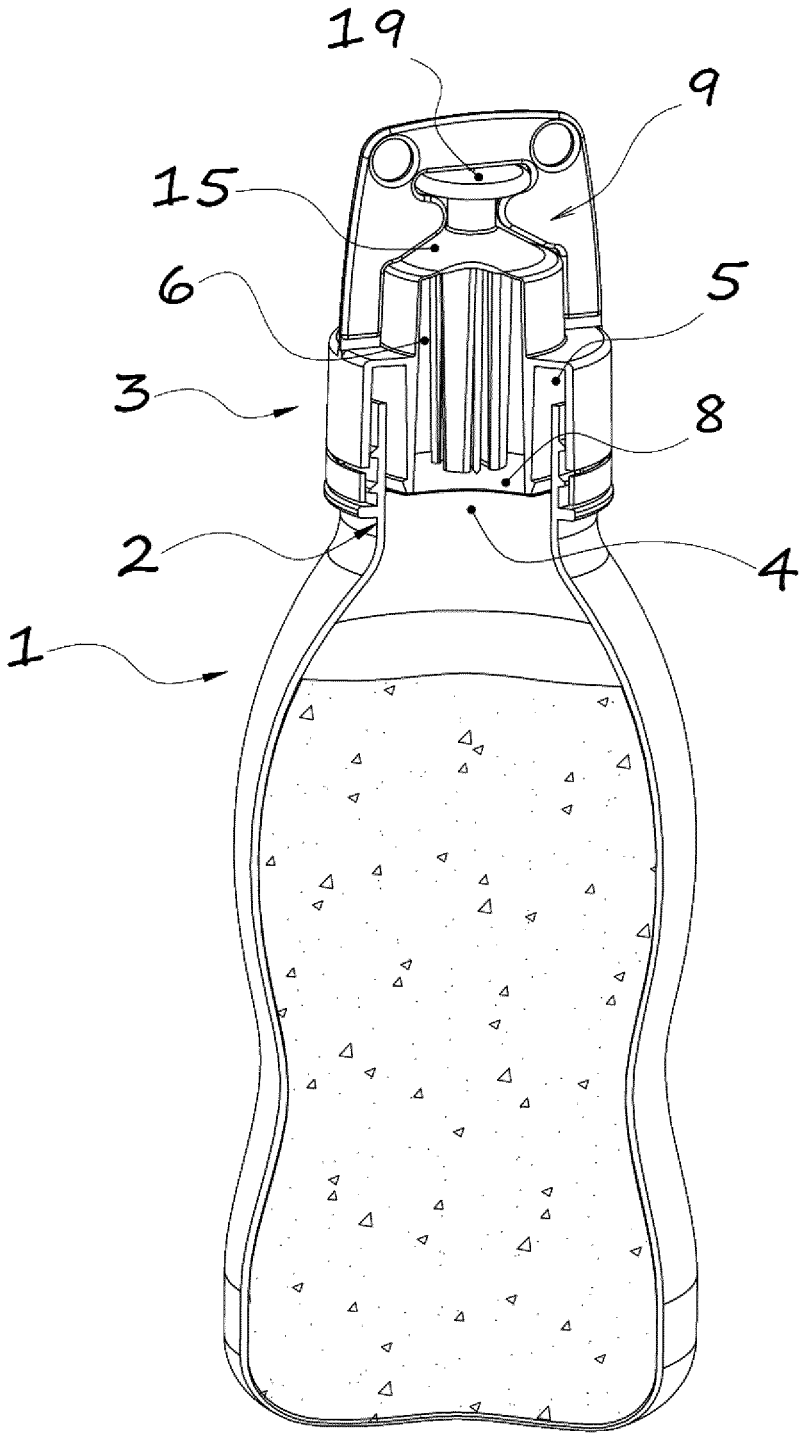

| | | | | |
|---|---|---|---|---|
| 2012/0199503 | A1* | 8/2012 | Dyrbye | B65D 47/243<br>206/222 |
| 2013/0175188 | A1* | 7/2013 | Scarpa | B65D 51/2821<br>206/222 |
| 2013/0292275 | A1* | 11/2013 | Smart | B65D 51/2835<br>206/222 |
| 2015/0016208 | A1* | 1/2015 | Larson | B65D 25/08<br>366/130 |
| 2015/0144511 | A1* | 5/2015 | Hamway | B65D 51/2835<br>206/222 |
| 2016/0083156 | A1* | 3/2016 | Dyrbye | B65D 51/2864<br>206/222 |

* cited by examiner

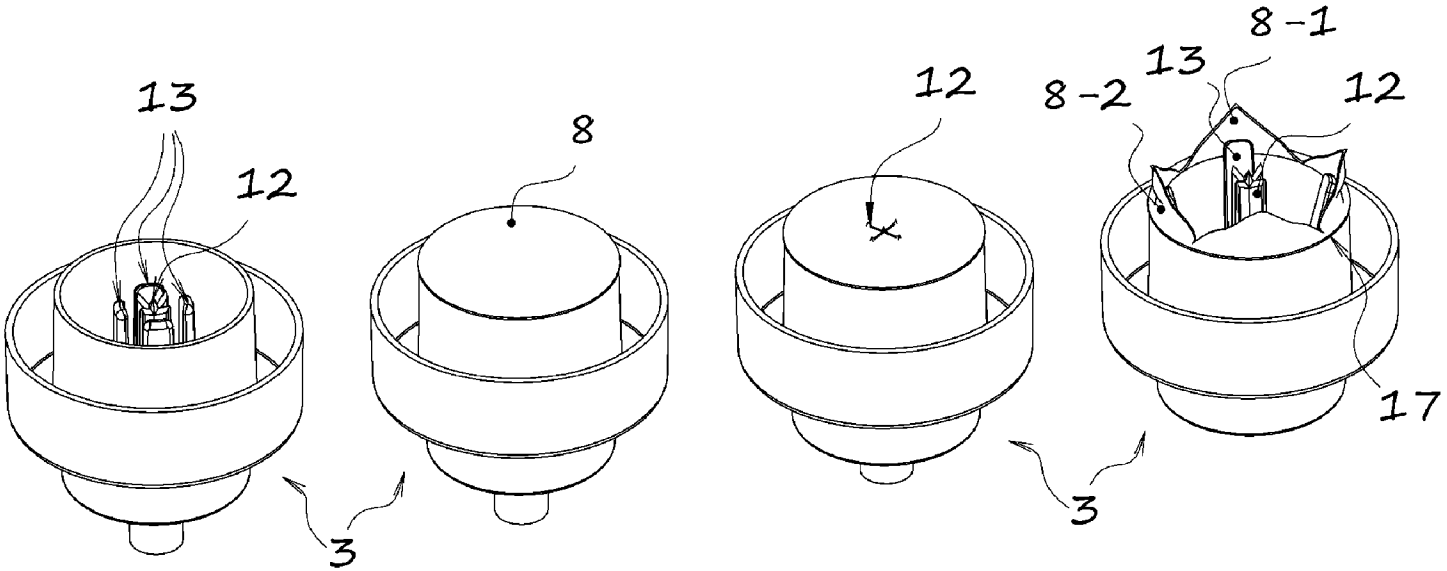
Fig 3e
Fig 3f
Fig 3g
Fig 3h
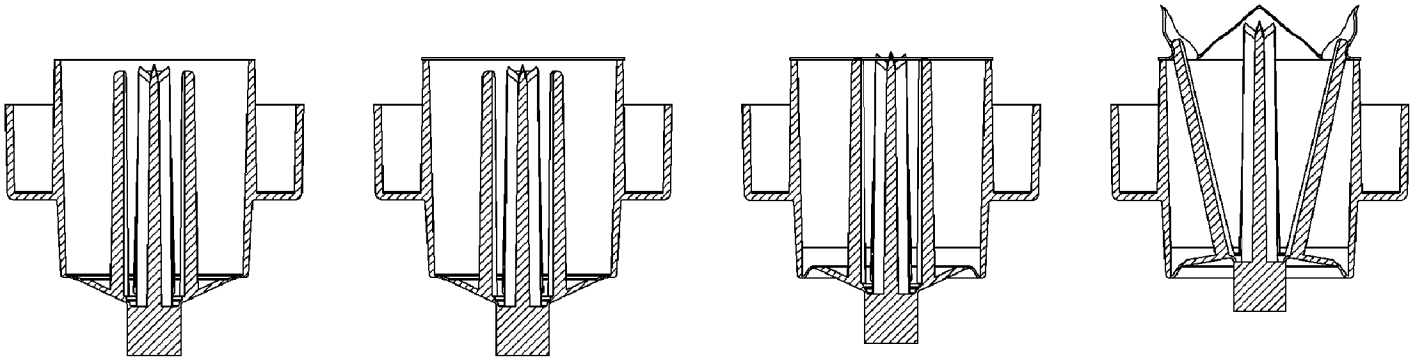
Fig 3a
Fig 3b
Fig 3c
Fig 3d

CONTAINER WITH MULTI DEPRESSIBLE CAP PRESS TOP

CROSS-REFERENCE TO A RELATED APPLICATION

The invention described and claimed hereinbelow is a National Stage Application of PCT/EP2015/081471, filed on Dec. 31, 2015 (the PCT application), now filed in the United States under 35 USC § 371. The content of the PCT application is incorporated by reference herein. The PCT application provides the basis for a claim for priority of invention.

BACKGROUND OF THE INVENTION

The present invention relates to a substance container, a container cap to be filled with an additive, and a method wherein to a substance in the container with thereon the cap an additive present in a cap space is to be added.

Substance containers provided with a cap with therein some additive are popular nowadays. The additive has to be kept isolated and water tight separated from the content of the container until the user decides to mix them. Thereafter the cap can for example be unscrewed from the spout of the container to consume the mixture.

OBJECTS AND SUMMARY OF THE INVENTION

It is an object of the present invention to provide an improved substance container, cap and method for storing and conserving the additive in the cap as well as for effectively liberating the additive and mixing it with the substance in the container in a way as less obstructive as possible and by means of an easily, safely operated, reliably reproducible and easy to manufacture cap.

Thereto the substance container, cap and method according to the invention have the features of the independent claims.

It is an advantage of the present inventions that when generally manually pressing the press top of the cap, first the pushing means translate, that is move in a straight line, to and through the seal to sever the seal in seal parts. Till this time the spreading means do not spread and stay together. Only thereafter when one presses further on the press top the seal parts are spread out by the spreading means, which allows the additive to fall into and mix with the content of the container. Pressing and further pressing mark the operation according to the invention due to the arrangement of the two step controlled flexible top, wherein respectively the pushing translate the pushing means which sever the seal and thereafter the spreading means spread and open the seal parts further, while both the aforementioned means are attached to said opposite top side of the flexible press top. The two step flexing arrangement of the flexible top creates the wanted different movements of both said means during such pressing and further pressing respectively. Furthermore only one movement or movement direction is required for manually operating the press top cap which eases the user operations and handling of the substance container and cap according to the invention.

These two consecutive operating steps according to the invention solve a problem often experienced in practice with simultaneously piercing the seal and spreading the cut seal parts or even worse spreading before piercing through the seal In both these cases this leads to a poor access of the additive and a bad opening of the seal, leading to a defective mixing of additive and substance. In such cases more than once spreading means which are not equipped for taking up pushing forces that is piercing and cutting forces break off and/or the seal hardly opens or is ripped off. This may even lead to cutting means, spreading means and/or seal parts ending up in the mixture.

Most preferably the material of the seal is pre-weakened, which has several advantages, such as the fact that in that case lesser sharp pushing means are necessary as the seal material will be pushed and pierced at a lower applied force with reduced breaking chances. In addition the tears/rips made along the pre-weakened lines have sharp edges showing no frays, and furthermore the accuracy of the landing place of the pushing means on the seal to be severed as well as the place where the spreading means will spread the pushed through seal parts is less critical, as the seal is then mechanically weaker along its pre-weakened lines.

A very easy to manufacture embodiment of the container according to the invention is characterised in that the controllably flexing parts of the flexible press top are integrated in material of a flexible cone surrounding a press knob of the flexible press top.

This cone embodiment is particularly compact and easy to manufacture, at wish as a one piece cap. After pressing and further pressing respectively the flexing parts controllably bend/buckle and distort successively.

An advantageously combined embodiment of the substance container according to the invention is characterised in that the pushing means and the spreading means are both provided on a number of longitudinal tongues, which reach through the cap space having its cap space opening closed by a pre-weakened material seal, and which on their upper tongue ends are attached to the lower side of the flexible press top.

The tongues embody and are provided with both the pushing and spreading means and consequently less generally plastic material is required for manufacturing, less handling is involved in operating the cap and a reduced weight results.

A preferred embodiment of the method according to the invention is characterised in that the pushing means which are directed to the seal are initially at a distance (a) from the un-pushed seal.

Advantageously this prevents the pushing and/or spreading means, which are either or not provided on the tongues from unintentionally damaging the seal.

BRIEF DESCRIPTION OF THE DRAWING FIGURES

At present the substance container, cap and method according to the invention will be elucidated further together with their further advantages, while reference is being made to the appended drawings, wherein similar components are being referred to by means of the same reference numerals. In the drawings:

FIG. 1 shows a substance container provided with a cap both according to the invention closing off the container which has a tamper evident means mounted thereon.

Figure 2A:
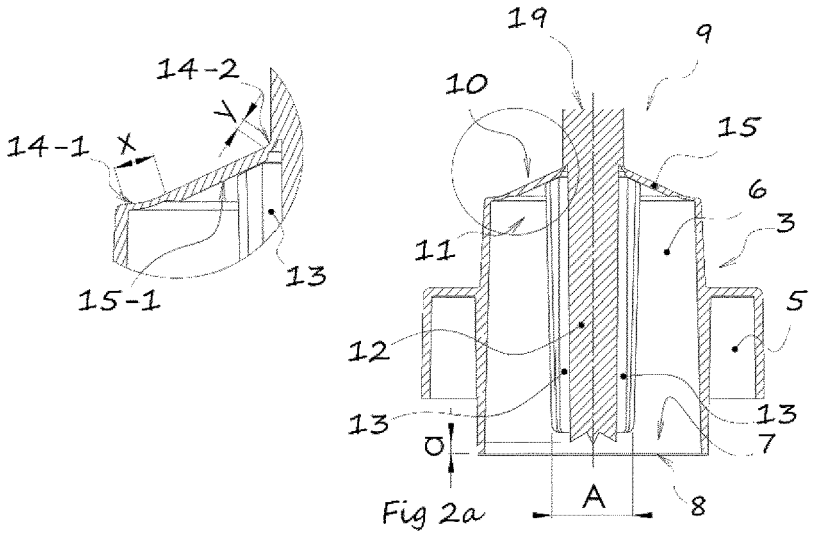
Figure 2B:
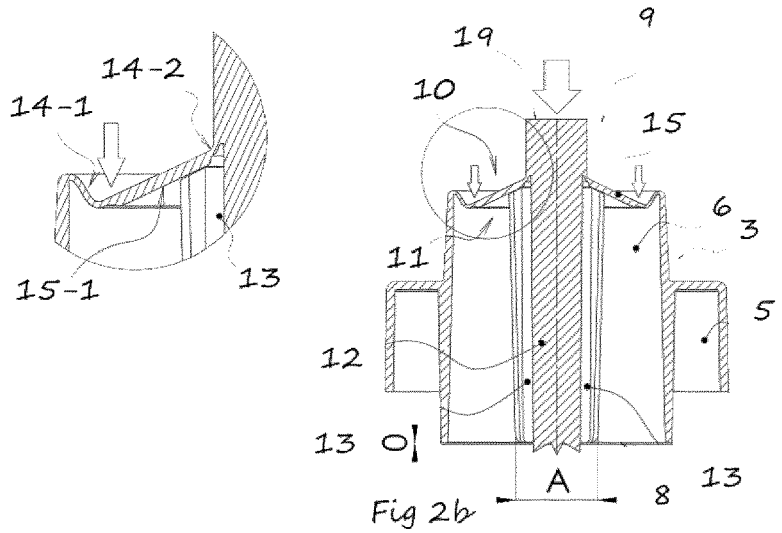
Figure 2C:
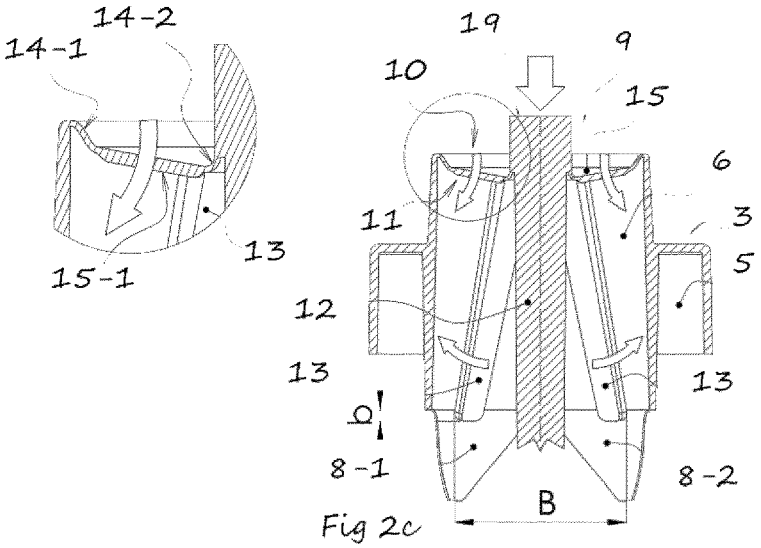

FIGS. 2*a*, 2*b* and 2*c* respective cross sections of the cap according to a first embodiment of the invention each with encircled enlarged details of respective press states of its flexible top.

FIGS. 3*a*-3*h* successive press positions of respective pushing means and spreading means of the cap according to the FIGS. 2*a*, 2*b* and 2*c* at successive press states of its flexible top.

Figure 4A:
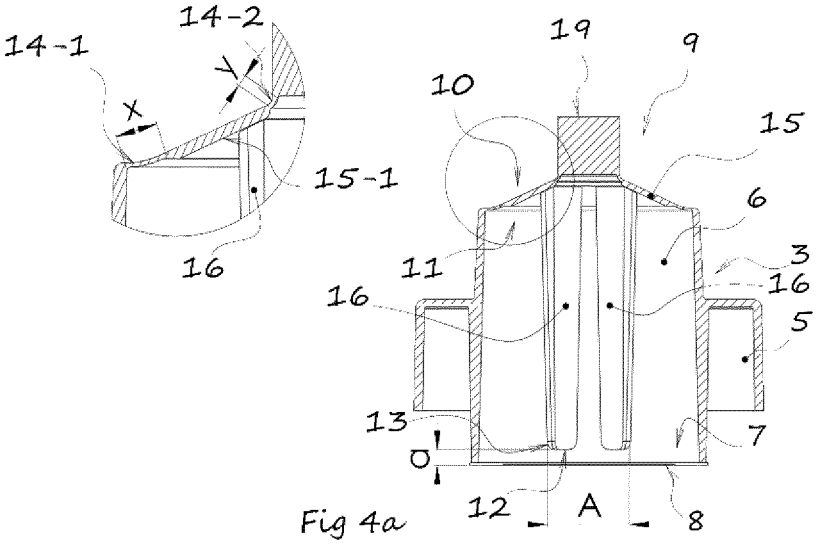
Figure 4B:
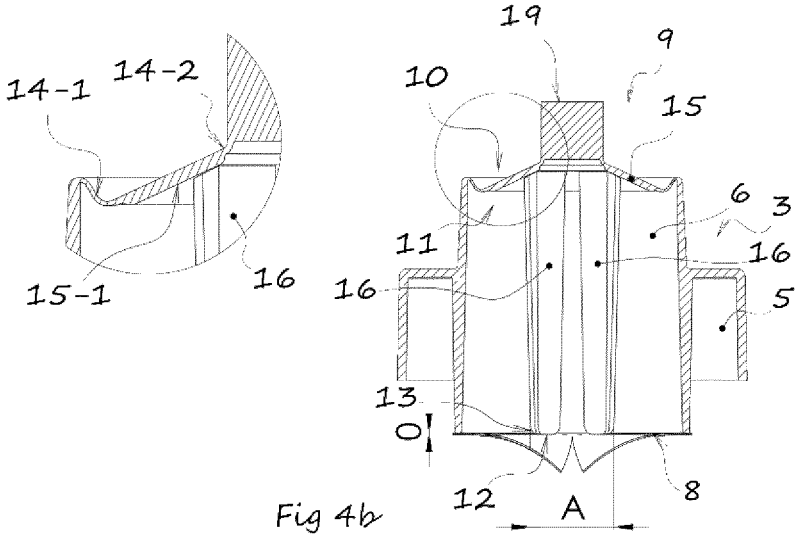
Figure 4C:
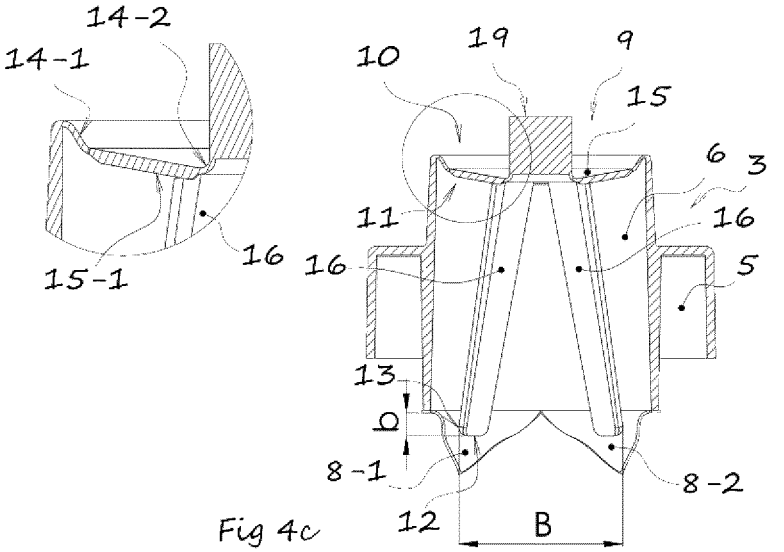

FIGS. 4*a*, 4*b* and 4*c* respective cross sections of the cap according to the second embodiment of the invention each with encircled enlarged details of respective press states of its flexible top.

FIGS. 5*a*-5*h* successive press positions of pushing means and spreading means both provided on tongues of the cap of FIGS. 4*a*, 4*b* and 4*c;*

Figure 6A:
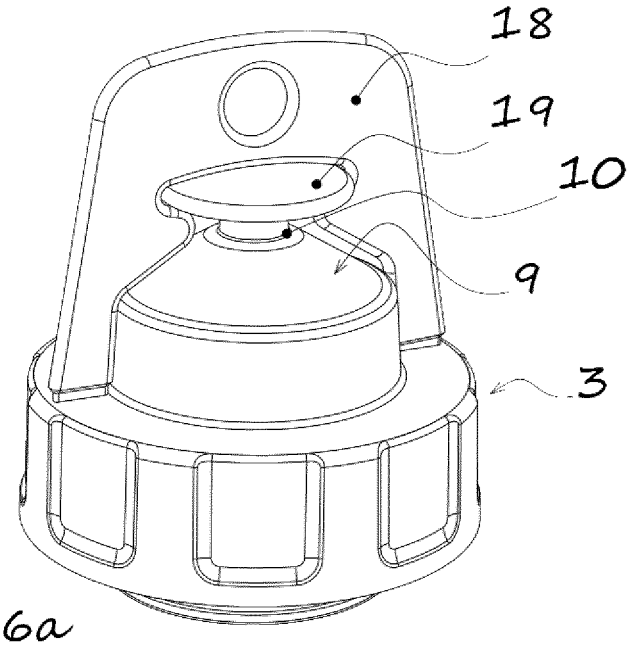
Figure 6B:
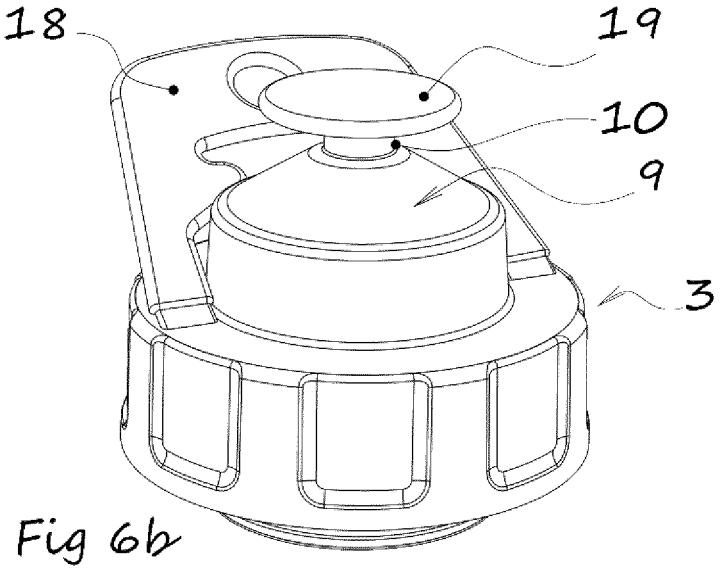
Figure 7A:
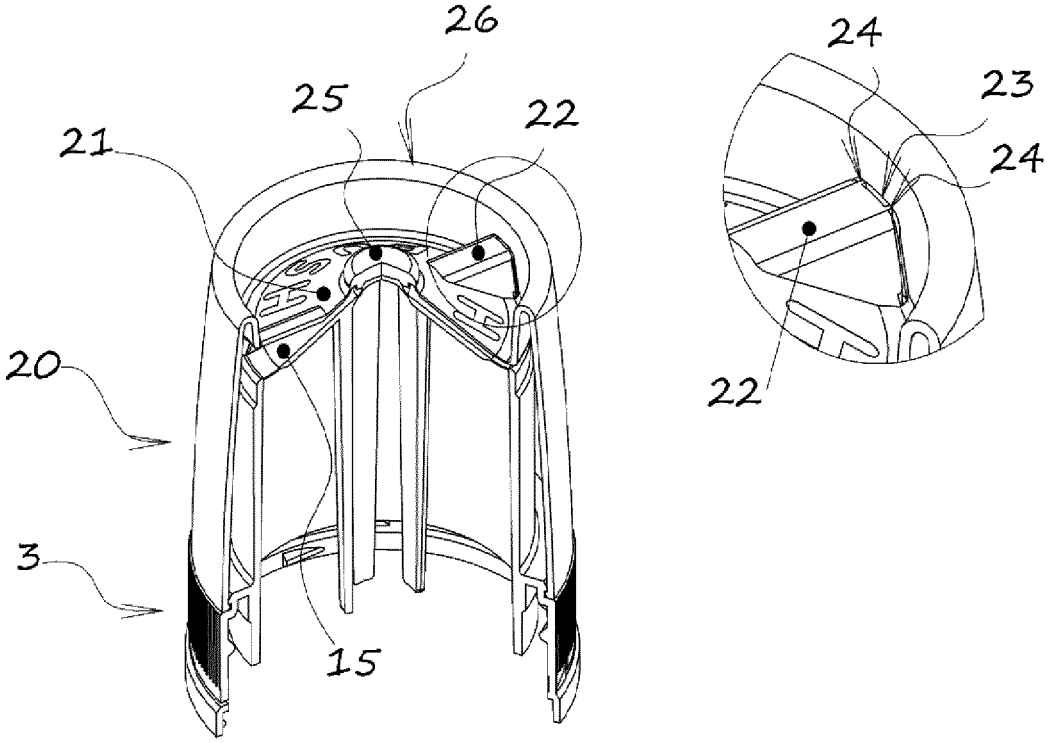
Figure 7B:
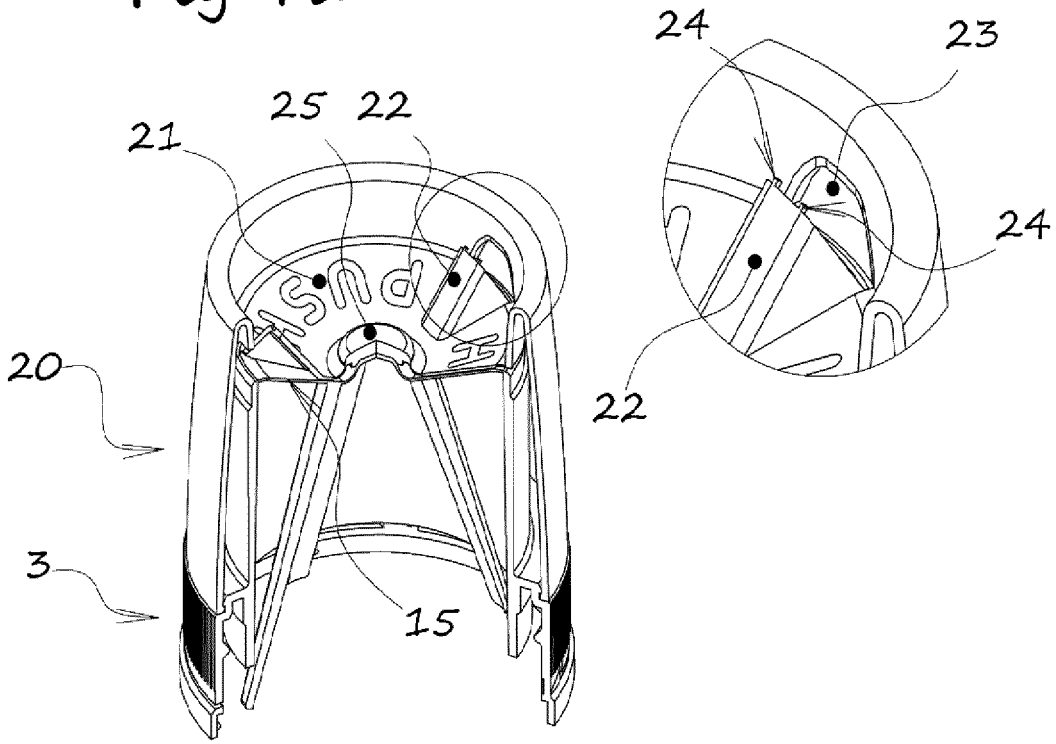

FIGS. 6*a* and 6*b* a tamper evident means on the cap according to either of possible embodiments of the invention in un-tampered and tampered states respectively; and FIGS. 7*a* and 7*b* a tamper-evident means in the form of an over cap on the cap in either of possible embodiments of the invention in un-tampered and tampered states respectively.

DETAILED DESCRIPTION OF THE INVENTION

FIG. 1 shows a container 1 meant to be filled with media, generally some liquid substance. The substance container 1 has a spout 2 whereon a cap 3 is provided which closes off the opening 4 of the spout 2 in an airtight manner. Normally the cap 3 is screwed on the spout 2, for example by means of an external screw thread on the spout 2 and an corresponding internal thread in a circumferential cavity 5 of the cap 3.

The cap 3 as further shown in the first preferred embodiment in cross sections in FIGS. 2*a*, 2*b* and 2*c* with accompanying encircled enlarged details defines a cap space 6 which is normally filled with an additive, such as a vitalising liquid or powder, which ultimately is to be mixed with the substance in the container 1, prior to being consumed. The additive may for example also be an additive or a liquid such as a drink, but for example also cleaning fluids, solvents, paints etcetera are possible.

The cap space 6 has an opening 7 which is closed by means of a seal 8. The material of the seal may for example comprise paper, carton, plastic, or a metal such as aluminium. The seal 8 may or may not be pre-weakened, as will be explained hereinafter.

The upper part of the cap 3 has a flexible press top 9 whose upper side 10 can be depressed. Opposite the side 10 the flexible top 9 has its opposite lower side 11. Attached to this opposite side 11 are one end of pushing means 12 which reach through the cap space 6, while their other ends are directed to the opening 7 of the cap space 6, as shown in FIG. 2*a*.

Attached to an annular conical relatively stiff part 15-1 at lower side 11 which lies in between controllably less stiff flexing parts 14-1 and 14-2 of the flexible press top 9 is a in this case truncated cone 15. The cone 15 surrounds a press knob 19 mounted centrally on top of the press top 9. Spreading means 13 reach through the cap space 6, while the lower ends of the means 13 are directed to the opening 7 of the cap space 6, as also shown in FIG. 2*a*. The lower ends of the spreading means 13 as shown here are at a slightly larger distance from the opening 7 than lower ends of the pushing means 12, whose lower ends are later intended to translate through the seal 8 (cf. a in FIG. 2*a*).

Upon depression of the flexible press top 9 the pushing means 12 which are attached to the lower side 11—as shown centrally at the lower end of the knob 19—translate to the opening 7 approach and contact the seal 8, as shown in FIG. 2*b*, and push through the seal 8, which may or may not be pre-weakened. If pre-weakened the pushing means 12 lower edges which sever the seal 8 do not have to be sharp; if not pre-weakened these edges may have sharper cutting edges. The flexible top 9 is further arranged such that the spreading means 13 also reaching through the cap space 6 are attached to the stiffer part 15-1 in the vicinity of the part 14-2, which in turn is stiffer than the part 14-1. So, if the knob 19 is being pushed the lower edges of the pushing means 12 push through the seal 8, and meanwhile the lower ends of the spreading means 13 hold their radial position. This position is being maintained until part 14-1 is fully deformed downwards, as shown in FIG. 2*b*. If knob 19 is further depressed then stiffer part 14-2 comes into operation and starts to flex. This marks the radial spreading of the lower ends of the spreading means 13 fixed close to that part 14-2 on the stiff part 15-1, shown in FIG. 2*c*.

In the embodiment as shown in FIG. 2 the holding of their radial position during the translation is technically realised by creating the two controllably flexing parts 14-1, 14-2 in the cone 15 of the flexible press top 9. Now in more detail going from the initial position of FIG. 2*a* to the first press position shown in FIG. 2*b* only the detailed left flexing part 14-1 deforms. This is done by a first deformation of only the part 14-1 of the flexible cone 15, which surrounds the knob 19. Thereto the part 14-1 is made broader, at least more flexible, than the other flexing part 14-2; the latter also lies closer to the centre of the side 10, 11. From FIG. 2*a* to FIG. 2*b* the stiffer conical surface 15-1 between the two flex parts 14-1 and 14-2 is parallel displaced downward and consequently the spreading means 13 are also parallel displaced, thus holding their radial position A. In response to the further depression the spreading means 13 are spread radially outwardly, as shown in FIG. 2*c*, to allow the additive and substance to be mixed. The further depression leads to the bending of flex part 14-2 and flipping of the flexible cone 15 from a convex shape to a concave shape. Consequently the cone part 15-1 is angularly displaced which spreads the spreading means 13 attached thereto to radial position B, while extending downward over a short distance b (FIG. 2*c*). This spreads the pushed and pierced seal parts 8-1, 8-2 radially outwardly.

Generally speaking the flexural stiffness of the material parts of the two flex parts 14-1, 14-2 differ, as the stiffness of part 14-2 is greater than that of part 14-1, at least in the direction in which the flexible top 9 is to be pressed. Different stiffnesses while using the same material of the cap 3 can be created by making a proper choice of the thicknesses and/or lengths x, y of the flexible parts 14-1, 14-2.

Preferably the press top 9 does not have to be kept manually depressed in order to keep the spreading means 13 in spread out state. This is achieved by devising the parts 14-1, 14-2 such that they both keep their buckled end positions and do not spring back.

The optimisation of integrating both the parts 14-1 and 14-2 in one flexible cone material eases the manufacturing, possibly in a one piece cap manufacturing process, reduces the dimensions of the cap and reduces its weight. The parts 14-1, 14-2, 15 if annular cone parts, secure an airtight closing of the cap space 6 filled with possibly hygroscopic and/or oxygen sensitive additives.

In particular the pushing and spreading of the seal 8 and seal parts 8-1, 8-2 in this first embodiment is outlined further in FIGS. 3*a*-3*h* showing successive positions of the central and radial pushing means 12 and separate transversal spreading means 13 at successive press states of the flexible top 9 where FIGS. 3*a*-3*d* show cross sections of the cap 8 and FIGS. 3*e*-3*h* show the respective perspective views.

FIGS. 3*a* and 3*e* show the cap 3 according to the first embodiment before the provision of the seal 8. FIGS. 3*b* and 3*f* can be related to FIG. 2*a* where the pushing means 12 are a distance a above the seal 8 to prevent accidental cutting of the seal 8. FIGS. 3*c* and 3*g* can be related to FIG. 2*b* where the pushing means 12 have pushed through the seal 8 and the spreading means 13 contact seal 8. FIGS. 3*d* and 3*h* show the seal 8 being spread by the spreading means 13.

More preferably the spreading means 13 extend in tangential direction within the cap space 6 relative to the radial direction which is perpendicular thereto, which is shown in FIG. 3*e*. FIGS. 3*c* and 3*g* show the pushing of the seal 8 creating the pushed through seal parts 8-1, 8-2 etcetera. FIGS. 3*d* and 3*h* show the situation after the consecutive spreading of these parts. Preferably the pierced seal parts 8-1, 8-2 are spread out till against edges 17 of the opening 7 of the cap 3 which makes it easier for powders to fall out or to be rinsed out of the cap space 6. This is in particular true for grains and powders which tend to coagulate in the corners of the cap space 6, for example hygroscopic powders and/or oxygen sensitive additives, which are generally more difficult to rinse or shake out.

The cap 3 as further shown in the second embodiment in cross sections in FIGS. 4*a*, 4*b* and 4*c* defines a cap space 6 which may likewise be filled with a additive, such as a vitalising liquid or powder, which ultimately is to be mixed with the substance in the container 1, prior to being consumed. Where in the first embodiment the pushing means 12 and spreading means 13 are separate means, said means 12 and 13 are both mounted on tongues 16.

Figures 5A, 5B, 5C, 5D, 5E, 5F, 5G, 5H:
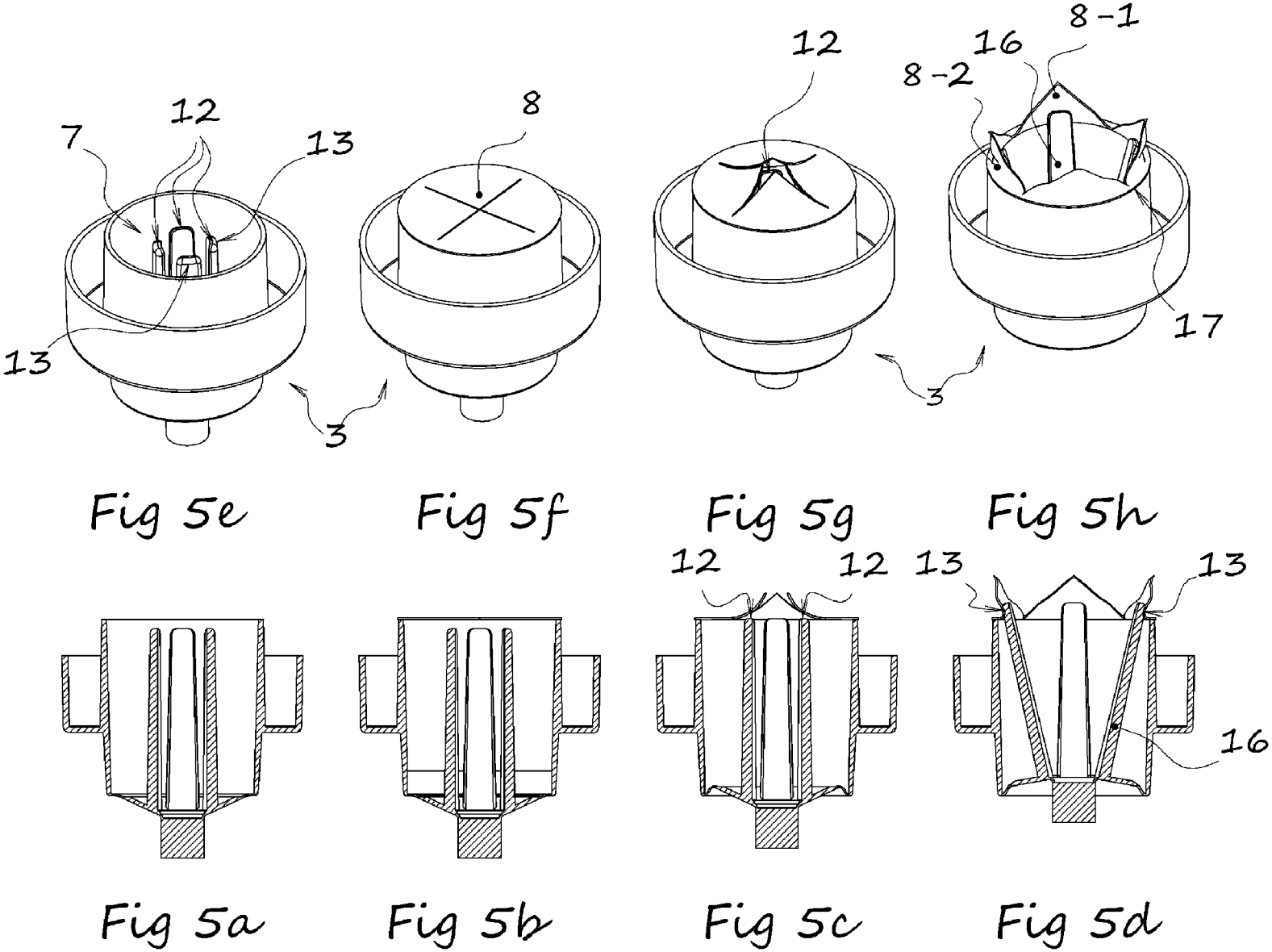

In particular the translating pushing and radial spreading of the seal 8 and seal parts 8-1, 8-2 in the second preferred embodiment is outlined further in FIGS. 5*a*-5*h* showing successive positions of the combined pushing/spreading means 12/13 both provided on tongues 16 at successive press states of the flexible top 9. FIGS. 5*a*-5*d* show cross sections of the cap and FIGS. 5*e*-5*h* the respective perspective views. FIGS. 5*a* and 5*e* show the cap according to the second embodiment before the provision of the seal 8. FIGS. 5*b* and 5*f* can be related to FIG. 4*a* where said means 12/13 are a distance, like a in FIG. 4*a*, above the seal 8 to prevent accidental cutting of the seal 8. FIGS. 5*c* and 5*g* can be related to FIG. 4*b* where the seal 8 is severed and torn apart by the lower ends of the tongues 16 at the here preferably pre-weakened areas and the distance a between the means 12/13 and seal 8 is approximately zero. FIGS. 5*d* and 5*h* show the seal 8 being spread by the means 13 present on the side edges of the tongues 16. FIG. 5*f* shows the seal 8 being pre-weakened, which can be done by partly pre-cutting the seal 8, etching or some other way such as with a laser to remove part of the seal surface material and make it partly thinner. Two crossing lines in FIG. 5*f* indicate pre-weakened seal lines. Consequently the intersection of these lines is weakest and thus it is most easy to start the contacting and pushing at this intersection, as this will cost less force to tear the seal 8 first. This also reduces the chance that the combined de-central pushing/spreading means 13 on the tongues 16 break.

The upper ends of in this case the combined means 12/13 are attached to said inner conical part 15-1 of the truncated cone 15. In case tearing starts at the intersection then tearing and spreading of cut seal parts 8-1 by the means 12 and 13 respectively may even take place by more rounded off means edges, which are easier to make. As shown the means 12/13 extend tangentially within the cap space 6, which is e.g. shown in FIG. 5*e*, as opposed to the pushing means radial extension elucidated with regard to the first cap embodiment. FIGS. 5*c* and 5*g* show the tearing of the seal 8 creating the pushed cut seal parts 8-1, 8-2 etcetera. FIGS. 5*d* and 5*h* show the situation after the consecutive spreading of these parts. Preferably the cut seal parts 8-1, 8-2 etcetera are spread out till against edges 17 of the opening 7 of the cap 3 which makes it easier for additives, such as powders to fall out or to be rinsed out of the cap space 6. This is in particular true for grains and powders which tend to coagulate in the corners of the cap space 6, for example hygroscopic powders, which are generally more difficult to rinse or shake out.

At wish any technical aspects of the explicitly described first and second embodiments may be combined.

FIGS. 6*a* and 6*b* show a tamper evident means 18 that is integrated as one single breakable part with the cap 3. In this case provided around and across at least the flexible top 9 and/or knob 19 on top of the upper side 10 in un-tampered and tampered states respectively. In order to be able to activate the cap 3 by pressing the upper side 10 and/or knob 19 it is necessary to bend the tamper evident means 18 to the side in order access the depressible upper side 10 and/or knob 19. When bending the tamper evident means 18 to the side small connections between tamper evident means 18 and knob 19 will be broken, clearly showing a tampering of the cap 3.

FIGS. 7*a* and 7*b* show a tamper evident over cap means 20 that comprises of a separate part that is attached to cap 3 by means of clicking, welding or any other means of attachment. The tamper evident means 20 has a truncated cone 21 just like cap 3 with a push area 25 at the centre. This push area is in contact with the upper push area side 10 of the cap 3. The truncated cone 21 of the tamper evident means 20 has a travel length that is equal or larger than the translation travel and travel caused by the flipping of the cone 15 of cap 3. The truncated cone 21 of tamper evident means 20 has areas 22 that are cut loose from the surroundings creating a gap 23 between areas 22 and the rest of tamper evident means 20. In the gaps 23 there are some small connections 24 between areas 22 and the rest of tamper evident means 20. When pressure is applied to the push area 25 in order to activate cap 3, the truncated cone 21 will flip from the convex shape in FIG. 7*a* to the concave shape in FIG. 7*b*. The areas 22 will rotate together with the angular movement of the truncated cone 21. During this movement the connections 24 will be torn. The torn connections 24 as well as the wide open gap 23 between areas 22 and the rest of cap 3 will clearly show tampering.

Advantageously the push area 25 of the tamper evident means 20 is protected from accidental activation because edge 26 is higher than the push area 25. Stacking of bottles cannot lead to accidental activation this way.

LIST OF REFERENCE SYMBOLS

Substance container 1
Spout 2
Cap 3
Opening 4 of 2
Cavity 5
Cap space 6
Opening 7 of 6
Seal 8, pushed through seal parts 8-1, 8-2
Flexible press top 9
Controllably flexing parts 14-1, 14-2
Upper side 10 of 9; lower side 11 of 9
Pushing means
Spreading means 13
Cone 15, annular part 15-1

Longitudinal tongues 16
Edges 17 of 7
Tamper evident means 18
Push knob 19
Over cap means 20
Truncated cone 21
Areas 22
Gap 23
Connections 24
Push area 25
Distances a, A, x, y, b, B

What is claimed is:

1. A substance container having a cap that defines a cap space for an additive, the cap comprising:

a cap space opening to the cap space, the cap space opening closed by a seal which may or may not be pre-weakened; and an upper cap part including a flexible press top formed with a depressible upper side and an opposite lower side;

pushing means having a first end attached to the opposite lower side of the flexible press top, and a second end opposite the first end and extending through the cap space directed to the cap space opening; and spreading means having a first end attached to the opposite lower side of the flexible press top, and second end opposite the first end and extending through the cap space directed to the cap space opening;

wherein upon depression, the second end of the pushing means and the second end of the spreading means hold fixed radial positions during translation to the cap space opening, and wherein the second end of the pushing means contacts with and push through the seal;

wherein upon further depression, the second end of the pushing means and the second end of the spreading means extend out of the cap space past the seal, while the second end of the spreading means spreads radially outwardly away from the second end of the pushing means to allow the additive and substance to mix.

2. The substance container according to claim 1, wherein the flexible press top comprises a conical, relatively stiff flexing part, at the opposite lower side, arranged between controllably less stiff first and second flexing parts formed to flex in succession when the depressible upper side of the flexible press top is depressed and depressed further, and wherein the spreading means are attached to the conical relatively stiff flexing part in the vicinity of one of the first and second controllably less stiff flexing parts that flex during the further depression.

3. The substance container according to claim 2, wherein a press knob is mounted centrally on top of the press top's conical, relatively stiff flexing part and the controllably less-stiff first and second flexing parts.

4. The substance container according to claim 2, wherein the controllably less stiff first and second flexing parts are annular inner and outer parts separated by the conical, relatively stiff flexing part.

5. The substance container according to claim 1, wherein the controllably less stiff first and second flexing parts are hinges that display respectively mutually different stiffnesses.

6. The substance container according to claim 1, wherein the pushing means and the spreading means are provided on a number of longitudinal tongues, which have a first end attached to the opposite lower side of the flexible press top, and a second end opposite the first end that extends through the cap space, where the seal closing the cap space opening is formed of a pre-weakened material.

7. The substance container according to claim 6, wherein the longitudinal tongues form the pushing means and side edges of the longitudinal tongues form the spreading means.

* * * * *